US005690513A

United States Patent [19]

Fink et al.

[11] Patent Number: 5,690,513

[45] Date of Patent: Nov. 25, 1997

[54] HEADER CONNECTOR SNAP LOCK

[75] Inventors: Randy Lynn Fink, Warren; Michael Patrick Cummings, Canfield, both of Ohio

[73] Assignee: General Motors Corporation, Detroit, Mich.

[21] Appl. No.: 560,179

[22] Filed: Nov. 17, 1995

[51] Int. Cl.[6] ..... H01R 13/60

[52] U.S. Cl. ..... 439/567; 439/79

[58] Field of Search ..... 439/567, 79, 571

[56] References Cited

U.S. PATENT DOCUMENTS

| | | | |
|---|---|---|---|
| 5,435,750 | 7/1995 | Kosmala | 439/567 |
| 5,478,253 | 12/1995 | Biechler et al. | 439/567 |
| 5,482,474 | 1/1996 | Yohn et al. | 439/567 |

FOREIGN PATENT DOCUMENTS

| | | | |
|---|---|---|---|
| 3603250 | 8/1987 | European Pat. Off. | 439/79 |

*Primary Examiner*—Khiem Nguyen
*Assistant Examiner*—Eugene G. Byrd
*Attorney, Agent, or Firm*—Michael J. Bridges

[57] ABSTRACT

A header connector snap lock apparatus for securing a header connector to a printed circuit board through insertion of semicircular header connector pegs into corresponding circular printed circuit board openings allowing for circuit board thermal expansion, for example during a wave solder process, and dispersing peg strain concentration through insertion force deflection of the peg and the beam along at least three deflection planes through use of a channeled, slotted cantilever beam extending out from the header connector and from which the peg extends.

15 Claims, 4 Drawing Sheets

HEADER CONNECTOR SNAP LOCK

FIELD OF THE INVENTION

This invention relates to printed circuit board header connectors and, more particularly, to an apparatus for securing a header connector onto a printed circuit board.

BACKGROUND OF THE INVENTION

Wiring harnesses are typically connected to electronic circuits on printed circuit boards by means of an electrical plug connector and an electrical header connector that are matched and are attached to the wiring harness and printed circuit board, respectively. The header connector includes a plurality of L-shaped pin terminals projecting vertically out of the header connector through plated contact holes of the circuit board when the header connector is mated with the circuit board. The L-shaped pin terminals and the plated contact holes are wave soldered together to provide for communication of electrical signals between the electronic circuitry of the circuit board and the wiring harness. To secure the header connector to the printed circuit board during the wave solder process, projections are known to extend from the header connector to pass through corresponding holes in the circuit board. The projections are sized to fit securely in the corresponding holes to minimize movement of the header relative to the circuit board during the wave solder process. The wave solder process passes along the side of the circuit board opposite the side on which the header connector is disposed, and significantly elevates the temperature of the circuit board, causing thermal expansion of the circuit board. The thermal expansion can significantly increase a spacing between the circuit board holes, which increase is restrained by the projections securely installed in the holes, leading to circuit board warping. Circuit board warping can decrease the integrity of solder connections between plated contact holes of the circuit board and contact pins of electronic components soldered thereto-especially connections near the middle of the circuit board where warping deflection can be most severe.

It would therefore be desirable to provide for secure attachment of the header connector to the circuit board during the wave solder process without restraining circuit board thermal expansion.

The projections for securing the header connector to the circuit board are known to take the form of solid pegs or projections extending in a downward direction from a header connector housing, or extending in the downward direction from a cantilever beam that extends outward from the header connector housing. The cantilever beam reduces rotational movement of the header connector relative to the circuit board. As the projections or pegs are inserted into the corresponding printed circuit board holes, they are deflected in position substantially along a single deflection plane, resulting in a concentration of deflection strain at a single point or region on the projection or peg. Conventional header materials, such as materials containing about thirty percent glass filled polyester, have relatively low deflection strain limits, which typically correspond to a header connector of a robust geometry. Header connectors must have a robust geometry (dimensional stability) for proper header connector interfacing with the printed circuit board and the plug connector. High strain concentration at any point on the conventional projection or peg, such as occurs during the described insertion process, can exceed such conventional strain limits and can unacceptably increase the potential for breakage of the projections or pegs. To reduce the potential for breakage, headers may be designed with material having a higher strain limit, such as nylon, which can reduce the dimensional stability of the header. It would therefore further be desirable to provide a header connector of a low cost, dimensionally stable material that has a low potential for peg or projection breakage during the printed circuit board insertion process.

SUMMARY OF THE INVENTION

The present invention provides a desirable header connector snap lock apparatus for securing a header connector to a printed circuit board which does not restrain significant thermal expansion of the board and which reduces insertion force strain concentration by dispersing the strain concentration in a plurality of deflection planes, providing for use of dimensionally stable header connector materials with low potential for peg breakage during the insertion process.

More specifically, a header connector includes at least two spaced cantilever beams extending outward from the header connector, each cantilever beam having a peg (or projection) with a semi-circular cross-section defining a semi-circular outer peg surface, each peg projecting in a downward direction from the cantilever beam and terminating in a head. The outer surface of each of the pegs may be opposite a header connector center position. The pegs are spaced in correspondence with the spacing of corresponding holes in a printed circuit board. The outer peg surface contacts and is deflected in an inward direction by engagement with an outer printed circuit board hole surface during a peg insertion process. The deflection of the peg is opposed by a peg strain force acting against the outer hole surface. The peg strain force of any one peg may be in a direction opposing that of the other pegs, to secure the header connector position relative to the circuit board. The substantially semi-circular peg shape and the substantially circular circuit board hole shape allows for a spacing between an inner peg surface opposing the outer peg surface and an inner hole surface opposing the outer hole surface, which spacing is taken up during thermal expansion of the circuit board so that such expansion is not opposed by the inserted peg, reducing the potential for printed circuit board warping.

In accord with a further aspect of this invention, each of the header connector cantilever beams includes a series of slots on the cantilever beam in proximity to the interface between the cantilever beam and the peg to disperse a portion of the insertion force to a plurality of deflection planes. The series of slots may comprise three slots arranged in a "U" shape on the beam around the peg to disperse the insertion force to a horizontal plane perpendicular to a vertical peg plane.

In accord with yet a further aspect of this invention, each cantilever beam is grooved or channeled along its length forming a hollow beam with inner and outer beam walls with the corresponding peg attached to at least a predetermined one of the beam walls to develop an additional deflection plane in parallel to the beam axis so that peg insertion force strain concentration may be further dispersed to the cantilever beam, further allowing for use of dimensionally stable header connector materials without high potential for breakage during the peg insertion process.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
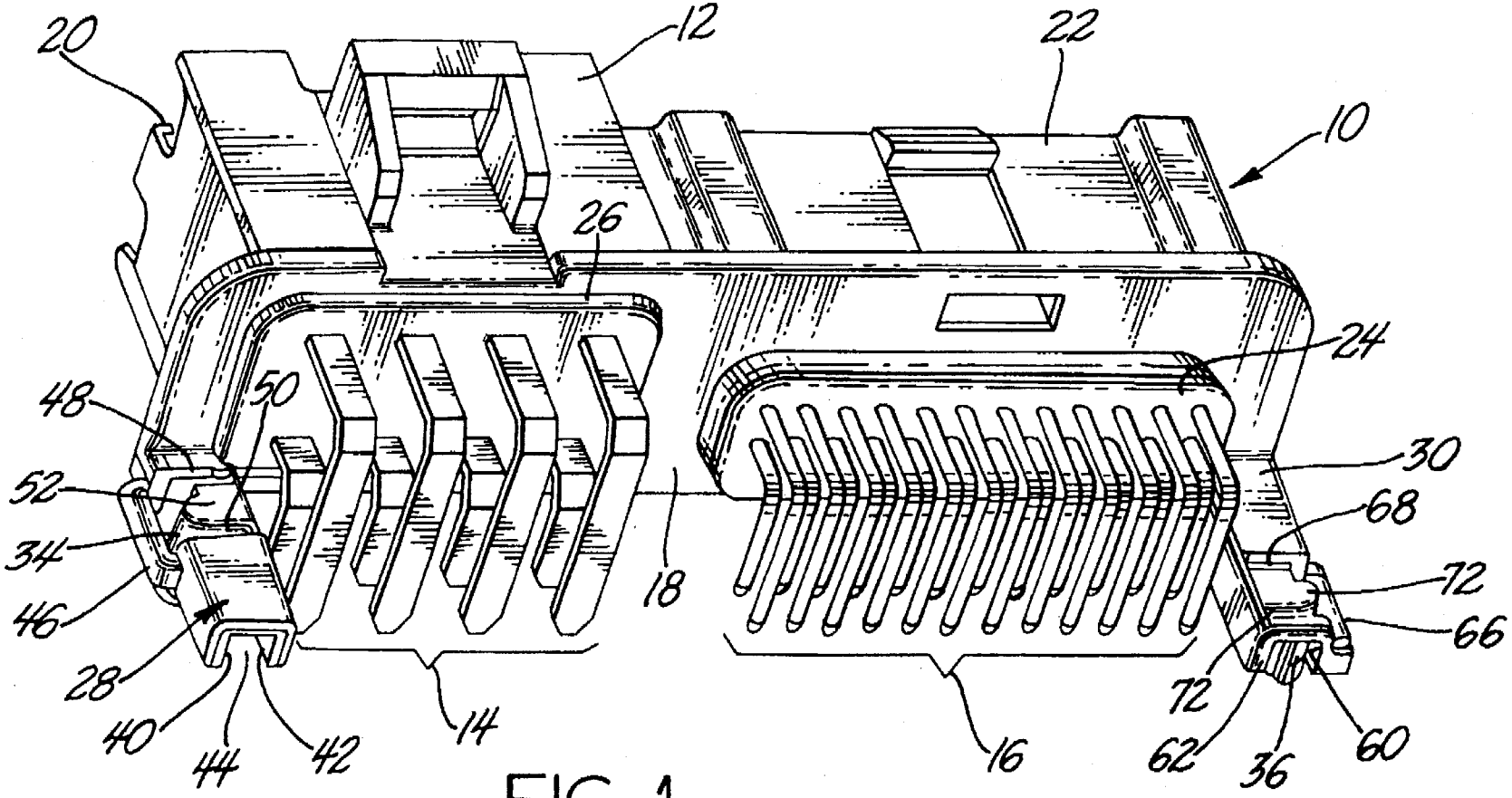
FIG. 1 is a general orthogonal view of a header connector with snap lock apparatus in accord with a preferred embodiment of this invention.

Referring to FIG. 1, header connector 10 having a housing 12 including, for example a first and second socket 20 and 22, respectively, for receiving one or more corresponding electrical plug connectors attached to a wiring harness (not shown) for communicating electrical signals between the wiring harness and a printed circuit board (not shown) to which the header connector 10 may be attached. A plurality of L-shaped electrically conductive pins, such as in the configuration of conventional pins 14 and 16 extend through a face 18 of the header connector 10 and into the sockets 20 and 22 for electrical connection to the electrical plug connectors. Pins 16 extend through a plastic gasket 24 disposed on the face 18, and pins 14 extend through a plastic gasket 26 disposed on face 18.

Upon connection of the header connector 10 to the printed circuit board, the downward pointing portion of each of the pins 14 and 16 extends through a corresponding plated hole in the printed circuit board (not shown) and is soldered to the plated hole during a conventional wave soldering process. To maintain the header connector 10 fixed in position relative to the printed circuit board during the wave solder process, a pair of spaced cantilever beams 28 and 30 are provided, connected to and extending out from the face 18. Beam 28 includes a projection or peg 34 extending outward therefrom in a downward direction for snap lock insertion through a hole in the printed circuit board (not shown). A groove or channel 44 is provided along the length of the underside of the beam 28 of this embodiment, forming inside beam wall 42 and outside beam wall 40. The peg 34 extends downward through the groove 44. A first slot 48 is provided through the cross section of the beam 28 on a first side of the peg 34 through a substantial portion of the beam cross section but not through the inside beam wall 42. Likewise, a second slot is provided through the cross section of the beam 28 on a second side the peg 34 opposing the first side of the peg 34 through a substantial portion of the beam cross section but not through the inside beam wall 42. The beam 28 is cut around the outer face of the peg 34 to form a "U" shaped opening around the peg 34. An L-shaped peg top 52 is thereby formed attached to the peg 34 and attached substantially perpendicularly to the inside beam wall 42. A support member 46 is attached to the beam 28 bridging the "U" shaped opening to provide structural support along the length of the beam 28.

The cantilever beam 30 likewise includes a projection or peg 36 extending outward therefrom in a downward direction for snap lock insertion through a hole in the printed circuit board (not shown). A groove or channel (not shown) is provided along the length of the underside of the beam 30 of this embodiment, forming inside beam wall 62 and outside beam wall 60. The peg 36 extends downward through the groove or channel. A first slot 68 is provided through the cross section of the beam 30 on a first side of the peg 36 through a substantial portion of the beam cross section but not through the inside beam wall 62. Likewise, a second slot 70 is provided through the cross section of the beam 30 on a second side the peg 36 opposing the first side of the peg 36 through a substantial portion of the beam cross section but not through the inside beam wall 62. The beam 30 is cut around the outer face of the peg 36 to form a "U" shaped opening around the peg 36. An L-shaped peg top 72 is thereby formed attached to the peg 36 and attached substantially perpendicularly to the inside beam wall 62. A support member 66 is attached to the beam 30 bridging the "U" shaped opening to provide structural support along the length of the beam 30.

Figure 2:
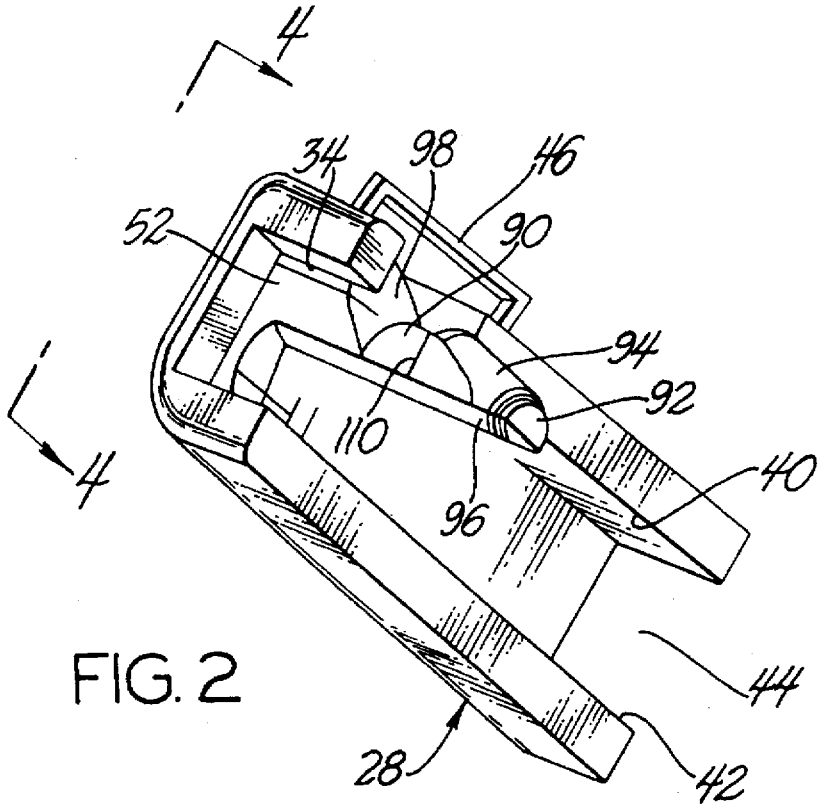
FIGS. 2 and 3 are orthogonal views of the cantilever beam and peg of the header connector snap lock apparatus of FIG. 1.
Figure 3:
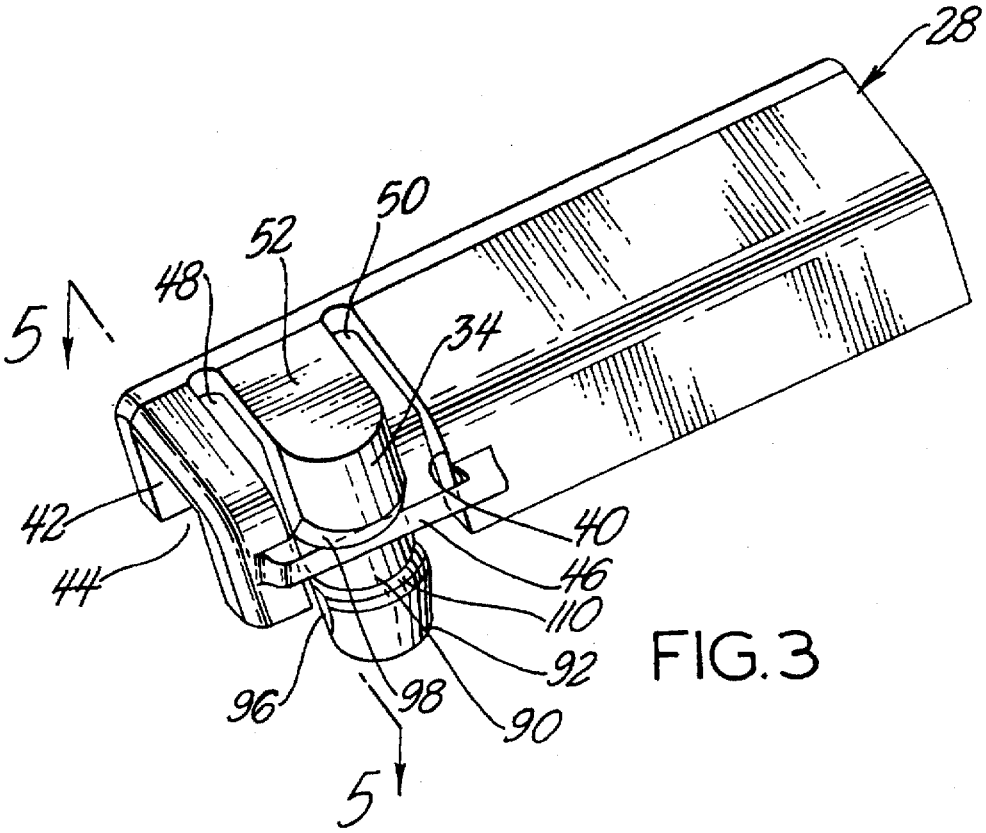

Further structural detail of the cantilever beams 28 and 30 of FIG. 1 are provided through the orthogonal views of FIGS. 2 and 3. These views are described in reference to beam 28 of FIG. 1, but may likewise apply to further define the structure of the beam 30 of FIG. 1. Referring to FIG. 2, beam 28 includes groove or channel 44 along its length forming opposing inside and outside walls 42 and 40, respectively. Peg 34 extends downward through the channel 44 and is connected to inside wall 42 via peg top 52. The peg 34 combined with the peg top 52 thereby form an "L" shaped member attached to the inside wall 42. The peg includes a tapered portion 98 adjacent a peg neck 90 which extends downward into a tapered peg head 94 including a retain edge or shoulder 110. The tapered peg head 94 is of a semicircular arc facing the outside wall 40, with an opposing inside portion or face of the peg 96 facing the inside wall 42. Further, the remaining portions of the peg 34 including the neck 90 and the tapered portion 98 may be of a semicircular shape, facing the outside wall 40. Still further, the inside face 96 of the peg 34 may be substantially flat, facing and substantially parallel to the inside wall 42, or may take the shape of an arc of smaller diameter than the diameter of the semicircular arc of head 94. Support member 46 is attached along the outside wall 40 to bridge a "U" shaped opening (FIG. 1) providing structural support of the wall 40. The peg head 94 is tapered gradually in diameter from the shoulder 110 to a peg end 92.

Referring to FIG. 3, an orthogonal view of the cantilever beam 28 is provided for detailing further the "U" shaped opening including first and second slots 48 and 50 around peg 34, with peg top 52 attached to inside wall 42 of the beam 28, the inside wall formed by channel 44 along the beam length also forming outside wall 40. The peg 34 extends through the channel or grove 44 and includes tapered portion 98 for reducing the diameter of the peg 34 into the relatively small diameter neck portion 90 which is attached to tapered peg head 94. The peg head is tapered from the shoulder 110 to peg end 92. The peg 34, including for example the peg head 94, neck 90, and tapered portion 98 are of a semicircular shape facing the outside wall 40, with an inside peg face 96 opposing the semicircular shaped portion thereof and facing the inside wall 42. Support member 46 is attached to the outside wall 40 and extends across the "U" shaped opening for structural support of the wall 40 and not for supporting the peg 34, for dispersing insertion force strain concentration, as will be described.

Figure 4:
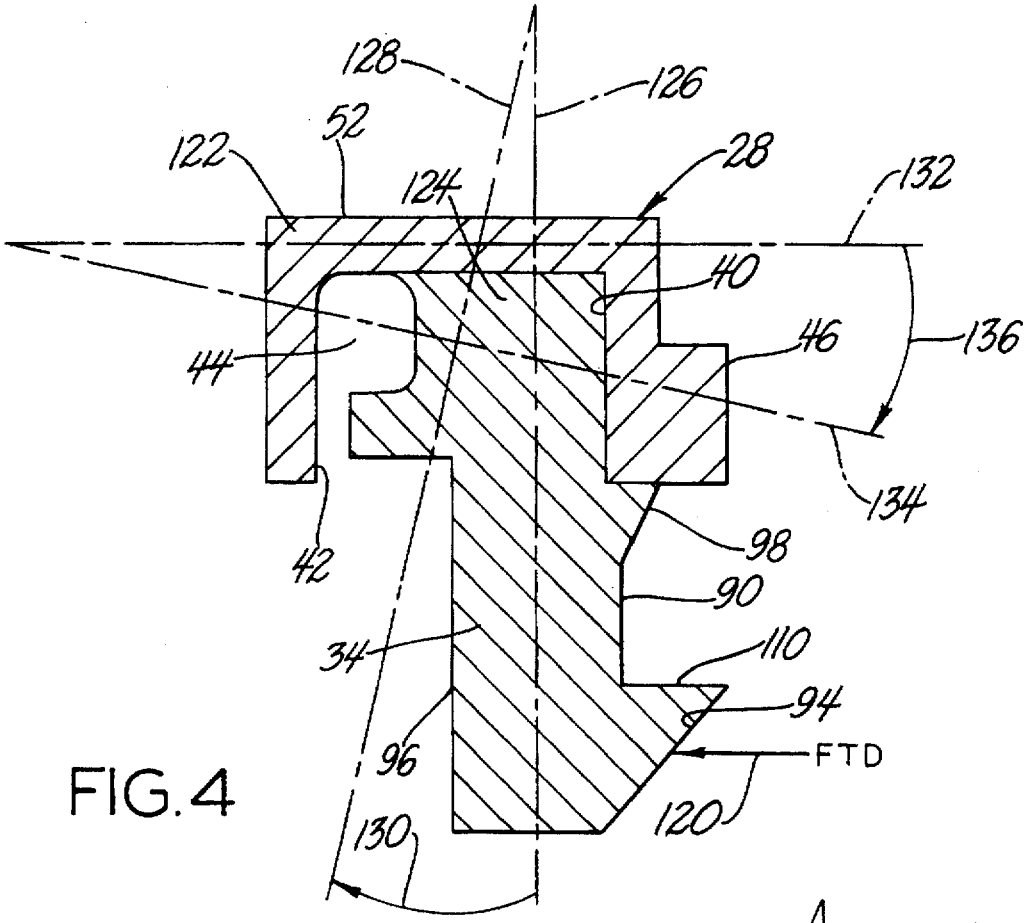
FIG. 4 is a side view of the cantilever beam of FIG. 2 taken along reference 4—4.

Referring to FIG. 4, a side view of the cantilever beam 28 of FIG. 2, taken along reference 4—4 (FIG. 2), details the groove or channel 44 along the beam length forming inside wall 42 and outside wall 40. Peg 34 extends downward through the channel 44 and includes tapered portion 98, neck 90, shoulder 110 and tapered head 94 tapering from the shoulder 110 to the end 92. Inside peg face 96 facing the inside wall 42 includes finger 112 extending out substantially perpendicularly from the inside peg face 96 toward the inside wall 42. Upon insertion of the peg 34 into a substantially circular or elliptical printed circuit board hole such as hole 160 of FIG. 3 with an insertion force normal to the peg top 52, a force to deflect FTD is applied in proportion to the insertion force to the peg head 94 in direction to deflect the head 94 along the direction referenced as 120. FIG. 4 illustrates two planes of peg deflection resulting from such FTD, to disperse strain to the peg 34 and beam 28 in accord with an aspect of this invention. Specifically, the FTD will rotate the peg 34 from a reference position 126 toward the reference position 128 as indicated by deflection angle 130, resulting in a strain concentrated generally in region 124 of the peg 34, near the peg top 52. Additionally, due substantially to the described "U" shaped opening in the beam 28, the FTD will rotate the peg 34 and peg top 52 from the reference position 132 toward the reference position 134 as indicated by deflection angle 136, resulting in a strain force concentrated generally in region 122 which is generally the portion of the peg top 52 that is attached to the inside wall 42. The distribution of the insertion strain concentration as illustrated in FIG. 4 to at least the two indicated regions 122 and 124 lowers the strain concentration at any one region of the beam allowing for beam and peg construction using dimensionally stable materials with relatively low strain limits, in accord with an aspect of this invention.

Figure 5:
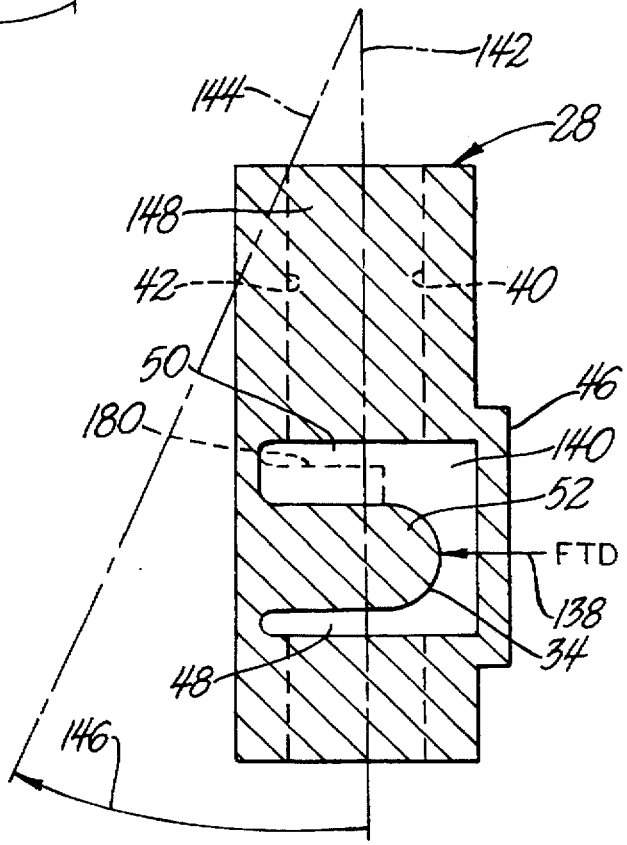
FIG. 5 is a top view of the cantilever beam of FIG. 3 taken along reference 5—5.

Referring to FIG. 5, a top view of the cantilever beam 28 taken along reference 5—5 of FIG. 3 illustrates the "U" shaped opening 140 in the beam 28 enclosed, in one embodiment of this invention, by the support member 46 bridging outside wall 40 for support thereof. The "U" shaped opening is formed through first and second slots 48 and 50 on opposing sides of the peg 34 having peg top 52. Slot 50 may, in an alternative embodiment within the scope of this invention, be stepped providing for a stepped portion 180 of peg top 52 for additional structural strength thereof to withstand peg top 52 strain.

Figure 7:
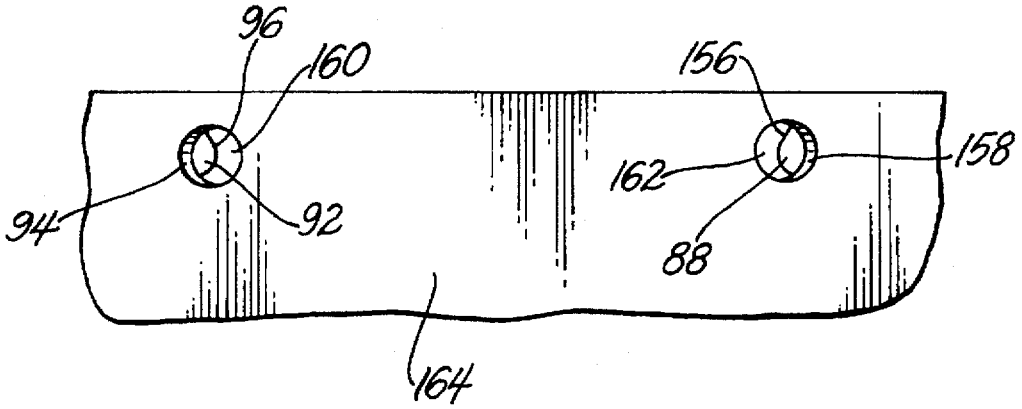
FIG. 7 is a general bottom view of the interface of FIG. 6 taken along reference 7—7.

Upon insertion of the peg 34 into a circular printed circuit board hole such as hole 160 of FIG. 7 with an insertion force normal to the peg top 52, a force to deflect FTD is applied in proportion to the insertion force to the recessed peg head (not shown) in direction to deflect the head along the direction referenced as 138. FIG. 5 illustrates a third plane of deflection resulting from such FTD, to even further disperse strain to the peg 34 and beam 28 beyond that described in reference to FIG. 4, in accord with a further aspect of this invention. Specifically, the FTD will deflect the beam 28 from reference position 142 toward reference position 144 indicated by deflection angle 146, resulting in a strain force concentrated generally in region 148-a third plane in which a portion of the strain force proportional to the insertion force is distributed-further reducing strain concentration at any one region of the peg 34 or beam 28 which further relieves material constraints on the peg and beam to allow construction thereof with dimensionally stable materials, as described. The groove or channel 44 adds beam structural flexibility along its length to provide for deflection of the beam along deflection angle 146.

Figure 6:
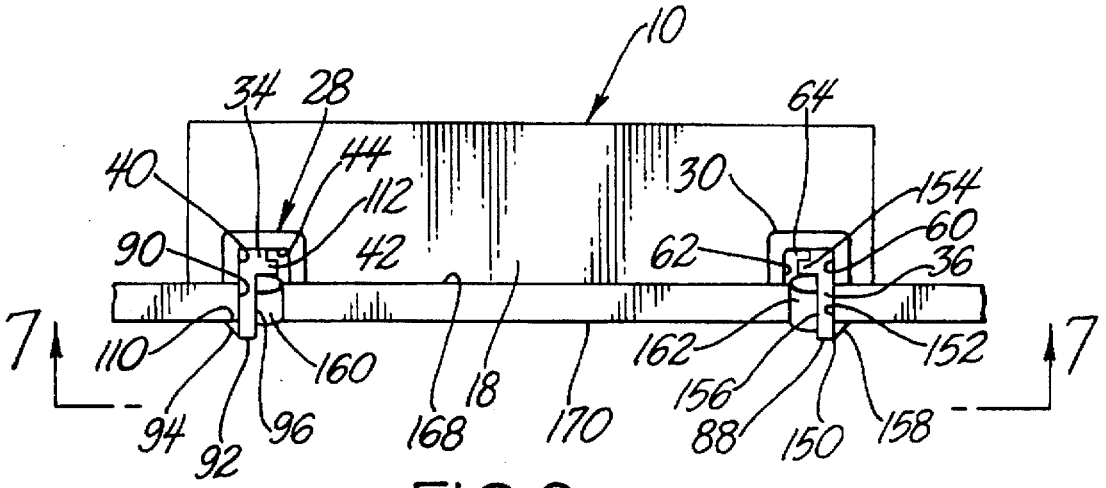
FIG. 6 is a general front view of the header connector-printed circuit board interface in accord with this embodiment.

Referring to FIG. 6, a general front view of the connector header 10 having face plate 18 disposed on a printed circuit board (PCB) 164 is provided illustrating the full insertion position of the pegs 34 and 36 into respective substantially circular or elliptical holes 160 and 162 of the PCB. The cantilever beam 28 including groove or channel 44 and inside and outside walls 42 and 40, respectively, rests on or in close proximity to an upper surface 168 of the PCB when the header connector 10 is in the fully inserted position of FIG. 6. The header connector 10 is vertically secured through a secure contact between shoulder 110 and a lower PCB surface 170 in a snap lock arrangement. The neck 90 of the peg 34 is urgingly disposed against an outside surface of the hole 160 to horizontally secure the header connector relative to the PCB 164. The described semicircular peg shape allows for a significant spacing between the inner face of the peg 96 and an inner surface of the corresponding hole 160 opposing the outer surface thereof, as illustrated further in FIG. 7 which provides a bottom view of the PCB-header connector arrangement of FIG. 6, taken along reference 7—7, illustrating the end 92, the inner face 96 and the head 94 of the peg 34 of FIG. 6, shown in a fully inserted installation on PCB 164.

Returning to FIG. 6, the cantilever beam 30 including groove or channel 64 and inside and outside walls 62 and 60, respectively, rests on or in close proximity to the upper surface 168 of the PCB when the header connector 10 is in the fully inserted position of FIG. 6. The header connector 10 is vertically secured through a secure contact between shoulder 150 of the peg 36 and a lower PCB surface 170. The shoulder 150 corresponds structurally to the shoulder 110 of the peg 34. The neck 152 of the peg 36 is urgingly disposed against an outside surface of the hole 162 to horizontally secure the header connector relative to the PCB 164. The semicircular peg 36 shape, corresponding to the described shape of peg 34, allows for a significant spacing between the inner face of the peg 156 and an inner surface of the corresponding hole 162 opposing the outer surface thereof, as illustrated further in FIG. 7 wherein the peg end 88, the inner face 156, and the tapered head 158 of the peg 36 are illustrated in a fully inserted installation on the PCB 164.

During the wave solder process or indeed during any process in which PCB temperature is elevated, thermal expansion of the PCB may occur resulting in an increase in the PCB width, including the distance between each of the holes 160 and 162. Such expansion is, up to a reasonable expansion of approximately 0.75 mm in this embodiment, substantially unopposed by the PCB-header connector arrangement of FIGS. 6 and 7 and in accord with an aspect of this invention, as there is no physical contact between the inner surface of the holes 160 and 162 and the peg inner faces, 95 and 156, respectively. Rather, the spacing 160 and 162 is taken up during such thermal expansion, narrowing the spacing width. Accordingly, PCB warping during the wave solder process is minimized and PCB electrical contact integrity is increased. Further, the deflection of the pegs 34 and 36 during and following the insertion process, providing for a secure, snug contact between the necks 90 and 152 and the respective inner surface of the holes 160 and 162 provides for an opposed retaining force between the two pegs 34 and 36 to retain the header connector in consistent horizontal position, for example to allow for precise wave solder processing. In other words, the pegs retain the header connector in position relative to the PCB in a complimentary fashion, so that through the combination of the two fully inserted pegs 34 and 36, the header connector 10 is substantially fixed in position relative to the PCB 164, but so that the PCB may expand in width, leading to an increase in spacing between the holes 160 and 162 up to a reasonable amount, as described, without opposition by the fully inserted pegs.

The preferred embodiment for explaining this invention is not to be taken as limiting or restricting this invention since many modifications may be made through the exercise of ordinary skill in the art without departing from the scope of the invention.

The embodiments of the invention in which a property or privilege is claimed are described as follows:

1. A header connector snap lock apparatus for securing a header connector to a printed circuit board having a plurality of spaced openings, the apparatus comprising:

a plurality of spaced cantilever beams attached to the header connector and extending outward from the header connector, each of the plurality of spaced cantilever beams having a peg with a semi-circular cross-section defining a semi-circular outer peg surface, each peg projecting in a downward direction from its corresponding cantilever beam and terminating in a tapered head;

wherein each peg is positioned to be received in a corresponding one of the plurality of spaced printed circuit board openings when the header connector is secured to the printed circuit board, wherein a deflection force acts between the outer peg surface and an outer surface of the corresponding printed circuit board opening to deflect the peg in an inward direction when received into the opening, the deflection resisted by a peg force retaining the outer peg surface against the outer surface of the corresponding opening to secure the header connector to the printed circuit board, and wherein a spacing between an inner surface of each peg opposing the outer surface of the peg and an inner surface of the corresponding printed circuit board opening opposing the outer surface thereof is present when the peg is received into the corresponding one of the printed circuit board openings, which spacing is reduced by an increase in the spacing between the printed circuit board openings.

2. The apparatus of claim 1, wherein each of the plurality of cantilever beams further comprises a first lateral slot adjacent a first side of the corresponding peg and a second lateral slot adjacent a second side of the corresponding peg opposite the first side of the corresponding peg, each of the lateral slots passing through a predetermined cross-sectional beam portion.

3. The apparatus of claim 2, wherein each of the plurality of cantilever beams further comprises a longitudinal slot along a longitudinal axis of the beam adjacent a third side of the corresponding peg between the first and second peg sides, the longitudinal and lateral slots forming a "U" shaped slot opening in the beam around the corresponding peg, providing for peg deflection along a predetermined horizontal peg plane when the peg is received into the corresponding printed circuit board opening.

4. The apparatus of claim 2, wherein each of the cantilever beams includes a longitudinal groove along a longitudinal beam axis.

5. The apparatus of claim 4, wherein the longitudinal groove is provided on an underside of each cantilever beam and forms an inside beam wall and an outside beam wall opposing the inside beam wall, the outside and inside beam walls joined by a beam top, wherein the first and second lateral slots pass through the outside beam wall and pass through a predetermined length of the beam top and do not pass through the inside beam wall, and wherein the corresponding peg is attached to the beam top between the first and second lateral slots.

6. The apparatus of claim 5, wherein the peg and the corresponding beam top form an "L" shaped member attached to the inside wall, the "L" shaped member deflecting along predetermined horizontal and predetermined vertical deflection planes in response to the deflection force, and the corresponding cantilever beam deflecting along a predetermined longitudinal beam deflection plane in response to the deflection force, to reduce peg strain concentration.

7. The apparatus of claim 1, wherein each of the cantilever beams includes a longitudinal channel along a longitudinal beam axis.

8. The apparatus of claim 7, wherein the longitudinal channel is provided on an underside of each cantilever beam and is bounded by an inside beam wall and an outside beam wall opposing the inside beam wall, and wherein the corresponding peg is attached to the inside beam wall.

9. The apparatus of claim 1, the printed circuit board having a perimeter with a plurality of sides, wherein the outer surface of each peg and the outer surface of each corresponding printed circuit board opening faces an adjacent printed circuit board side.

10. The apparatus of claim 1, wherein the plurality of spaced printed circuit board openings comprises two spaced openings, wherein the plurality of spaced cantilever beams comprises two spaced cantilever beams, and wherein the outer peg surface of the pegs of the two spaced cantilever beams are in mutually opposing positions to minimize, when the pegs are received into the corresponding printed circuit board openings, translational movement between the header connector and the printed circuit board.

11. A header connector snap lock apparatus for securing a header connector to a printed circuit board including two spaced holes, the apparatus comprising:

first and second spaced cantilever beams extending out from a first side of the header connector;

each cantilever beam being grooved along a longitudinal beam axis on an underside of the beam, forming opposing inside and outside beam walls joined by a beam top;

each cantilever beam having a peg with a cross-section extending in a downward direction therefrom; and each peg cross-section having a tapered circumference including an arc length of outer peg circumference forming an outer peg face and a remaining tapered peg cross-section, wherein the spacing between the cantilever beams is substantially matched with the spacing between the printed circuit board holes, and wherein each peg is positioned to be received in a corresponding printed circuit board hole for securing the header connector to the printed circuit board, wherein the peg is deflected in an inward direction when received into the corresponding printed circuit board hole, the deflection opposed by an outward peg force urging the outer peg face against a corresponding outer surface of the corresponding printed circuit board hole, and wherein a gap is present between the tapered peg cross-section and an inner surface of the printed circuit board hole opposing the outer surface thereof when the peg is received into the corresponding circuit board hole.

12. The apparatus of claim 11, wherein each cantilever beam further includes a first and a second lateral slot adjacent respective first and second sides of the corresponding peg and through a predetermined length of the cantilever beam cross-section including the outside beam wall.

13. The apparatus of claim 12, wherein each peg is attached to its corresponding beam at a portion of the beam top between the first and second lateral slots, the peg and the portion of the beam top thereby forming an "L" shaped member attached to the inside beam wall.

14. The apparatus of claim 11, wherein the outside beam wall and the outside peg face corresponding to the first cantilever beam are in opposing position of the outside beam wall and the outside peg face corresponding to the second cantilever beam.

15. The apparatus of claim 13, each outside cantilever beam wall further comprising a support member attached to the outside beam wall across the first and second lateral slots.

* * * * *